US005860696A

United States Patent [19]

Opsvik et al.

[11] Patent Number: 5,860,696

[45] Date of Patent: Jan. 19, 1999

[54] CUSHION FOR A CHAIR, ESPECIALLY A DETACHABLE CUSHION FOR A CHILD'S SEAT

[75] Inventors: Peter Opsvik, Oslo; Merete Hagen, Skodje, both of Norway

[73] Assignee: Stokke Fabrikker AS, Skodje, Norway

[21] Appl. No.: 737,455

[22] PCT Filed: May 9, 1995

[86] PCT No.: PCT/NO95/00077

§ 371 Date: Dec. 20, 1996

§ 102(e) Date: Dec. 20, 1996

[87] PCT Pub. No.: WO95/30360

PCT Pub. Date: Nov. 16, 1995

[30] Foreign Application Priority Data

May 10, 1994 [NO] Norway ..... 941761

[51] Int. Cl.[6] ..... A47C 7/02

[52] U.S. Cl. ..... 297/230.1; 297/224; 297/228.1; 297/219.1; 297/284.9

[58] Field of Search ..... 297/230.1, 230.11, 297/219.1, 219.12, 223, 224, 228.1, 228.12, 228.13, 452.34

[56] References Cited

U.S. PATENT DOCUMENTS

| | | | |
|---|---|---|---|
| 2,191,956 | 2/1940 | Coldren | 297/224 |
| 2,800,169 | 7/1957 | Armbrecht . | |
| 4,235,473 | 11/1980 | Rosenberg . | |
| 4,512,047 | 4/1985 | Johnson | 297/230.1 X |
| 4,828,320 | 5/1989 | Saiger . | |
| 5,005,903 | 4/1991 | Minardi . | |
| 5,042,878 | 8/1991 | Collins . | |
| 5,121,938 | 6/1992 | Gross et al. | 297/228.1 X |
| 5,248,182 | 9/1993 | Hittie | 297/230.1 |
| 5,275,463 | 1/1994 | Rocha . | |
| 5,310,245 | 5/1994 | Lyszczasz | 297/284.9 X |
| 5,441,328 | 8/1995 | Snyder | 297/452.34 X |

FOREIGN PATENT DOCUMENTS

| | | | |
|---|---|---|---|
| 660140 | 3/1965 | Belgium | 297/230.1 |
| 1082388 | 5/1960 | Germany | 297/219.1 |
| 1076422 | 1/1964 | United Kingdom . | |

*Primary Examiner*—Laurie K. Cranmer
*Attorney, Agent, or Firm*—Darby & Darby

[57] ABSTRACT

The present invention relates to a cushion for a chair (1), especially a demountable cushion (2) for a chair for children, and for the object of providing a cushion which simply and effectively can be mounted on a child's chair and correspondingly in a rapid and effective manner can be demounted therefrom, it is according to the invention suggested that the main shape (3) of the cushion comprises a main portion (4) serving to support the back portion of the user, and one or more side portions (5*a*, 5*b*) serving as extended support portion and/or affixing portion.

17 Claims, 4 Drawing Sheets

CUSHION FOR A CHAIR, ESPECIALLY A DETACHABLE CUSHION FOR A CHILD'S SEAT

FIELD OF THE INVENTION

The present invention relates to a cushion for a chair, especially a detachable cushion for a chair for children, comprising a main portion which substantially covers the user's back support.

BACKGROUND OF THE ART

From NO 132.782 (Peter Opsvik) there is known a chair for children comprising to side members which at the bottom merge into a leg support and at the top carry a back rest connecting the upper portions of the side members. At the inner surfaces of the side members there are provided tracks, wherein can be inserted the side edges of a seat plate and a foot plate, respectively, which plates thereby are given an optional height and thereby the possibility of being used by both small children, larger children and adult persons for one and same chair structure.

In connection with such chairs for children which usually are manufactured from wood or another suitable material, there has been a requirement for a back cushion and a seat cushion which in a simple manner can be attached to and detached from the back support and seat, respectively, for thereby improving the sitting comfort of the chair user.

U.S. Pat. No. 4,235,474 relates to a chair cushion for retaining a baby in a chair, but here the cushion is provided with an upper pocket which is to be threaded onto the back support. Consequently, this cushion does not comprise a specifically designed main portion rendering support for the back portion of the user, at the same time as the back portion comprises one or more side-portions combining the attachment of the cushion itself as well as additional support for the user, especially in connection with chairs for children both with and without a guard.

U.S. Pat. No. 4,824,320 relates to a cushion with assembled back portion and seat portion, but without slit side portions which in connection with for example chairs for children of the type "tripp-trapp" as discussed in said NO 132,782 can pave the way for additional upholstery whether such chairs are used with or without a sitting guard.

U.S. Pat. No. 5,005,903 relates to a child's auto seat, wherein is suggested an upholstery around the child's seat, such that a passengers placed next to the child's seat shall not be injured. Neither has this publication any relevance in relations to the present child's cushion.

U.S. Pat. No. 5,042,878 relates to an invalid chair cushion having side portions which do not form a part of the back portion, but a part of the seat front. It is true that there are suggested some very narrow attachment straps on the back portion, but these are only intended as means for attaching the cushion to the chair, see especially FIG. 3 in this publication. Otherwise, the discussed side portions constituting a part of the seat front are adapted to extend all around the chair back, which most apparently is seen in FIG. 2 of said publication. Said prior art side portions will thus constitute a separate part of the cushions main portion itself, and said prior art side portions can not on the one hand be used as means for attachment to the chair with expanded supporting portion, and/or attachment means on a supporting guard, at the same time as the expanded supporting function is conserved.

BACKGROUND OF THE INVENTION

An object of the present invention is to provide a cushion for a chair, especially a detachable cushion for a child's chair which in a rapid and simple manner can be mounted on a child's chair and also in a rapid and effective manner can be demounted from the chair in connection with cleaning.

A further object of the present invention is to provide a cushion for a child's chair which can be used not only for chairs for children without a child's guard, but which also can be used for the same chair when such a supporting guard is mounted thereon.

Another object of the present invention is to provide a cushion which can be manufactured in a simple and non-costly manner, at the same time as the material is utilized in an optimum way.

Still another object of the present invention is to provide a cushion for a child's chair giving the possibility for additional upholstering at optional portions without reducing the requirements for simple and rapid mounting and cleaning requirements.

SUMMARY OF THE INVENTION

These and other objects of the present invention are achieved by a cushion of the type as stated in the introductory part, which according to the invention is characterized in that the main shape of the cushion in addition to the main portion serving to support the back portion of the user also comprises one or more side portions serving as an extended supporting portion and affixing portion on chair back and/or child's guard.

Further features and characteristics of the present invention will appear from the following description taken in connection with the appended Figures, as well as from the appending patent claims.

BRIEF DISCLOSURE OF THE DRAWINGS

DISCLOSURE OF EMBODIMENTS

Figure 1:
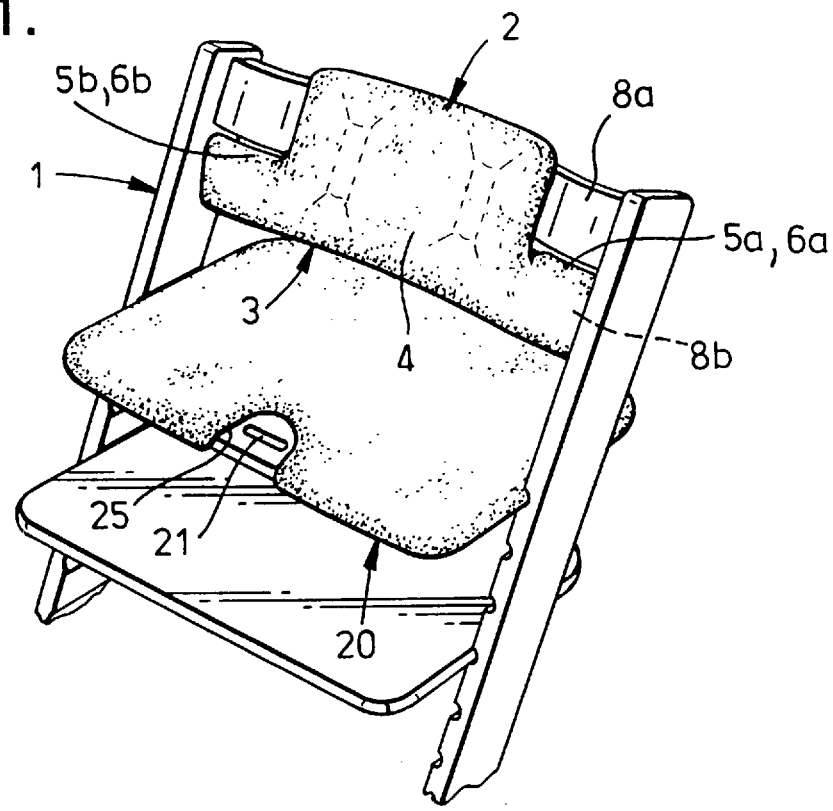
FIG. 1 is a perspective view as seen from the front of an upper portion of a chair having an adjustable seat and foot support, wherein an embodiment of a cushion according to the invention is included.

In FIGS. 1–6 there is in connection with a chair, here designated by reference numeral 1, especially a child's chair, illustrated a first embodiment of a demountable cushion 2 according to the present invention. The cushion 2 itself has a main shape 3 comprising a main portion 4 serving to support the back portion of the user, said cushion 2 also comprising one or more side portions, appropriately two side portions 5*a* and 5*b*, respectively, serving as an extended supporting portion and/or affixing portion.

Figure 2:
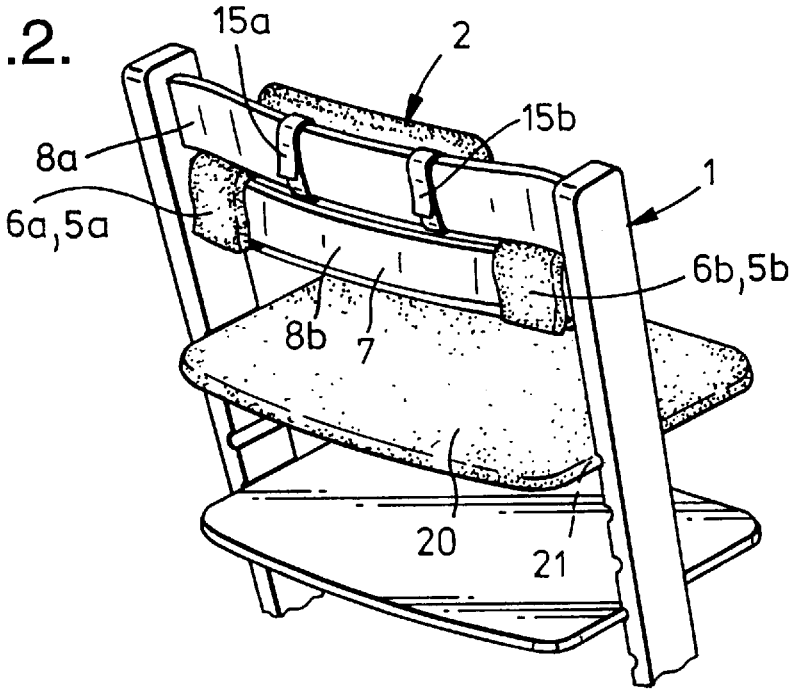
FIG. 2 is a perspective view similar to FIG. 1, but illustrates the same as seen from the opposite side, i.e. from the rear side of the chair.

In the embodiment illustrated in FIGS. 1 and 2, i.e. without any mounted guard, the side portions 5*a* and 5*b*, respectively, are provided as bendable portions 6*a*, 6*b* adapted to be affixed around a portion 7 of a back support 8*a*, 8*b*, and in the illustrated chair 1 the back support is composed of two parallel ribs 8*a*, 8*b*, extending substantially horizontally in a spaced relation. The side portions 5*a*, 5*b* of the cushion can then be adapted to be attached at the lower back support rib 8*b* of the chair 1 and will then serve to expand the back support portion in the area of this back support rib 8*b*.

Figure 3:
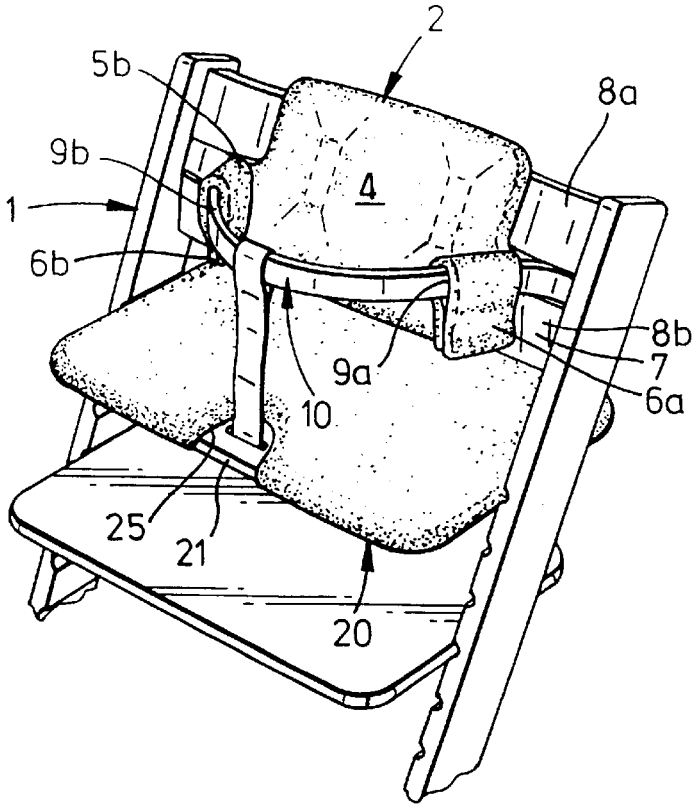
FIG. 3 is perspective view similar to FIG. 1, comprising the same type of adjustable chair, but having a child's guard mounted thereon, and here with the same embodiment of cushion according to the invention adapted to said guard.
Figure 4:
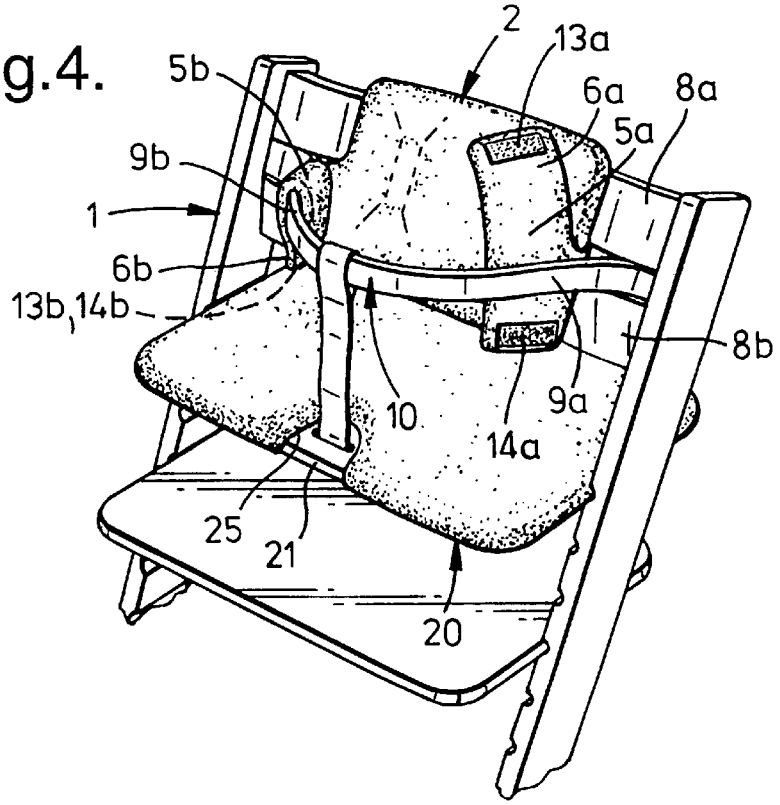
FIG. 4 is a perspective view similar to FIG. 3, wherein is specifically illustrated an embodiment for attachment means of the cushion according to the invention.

Alternatively, as illustrated in FIGS. 3 and 4 wherein the chair 1 is of the same type as illustrated in FIGS. 1 and 2, but wherein a child's guard 10 has been attached to the chair 1, the side portions 6*a*, 6*b* of the cushion 2 are appropriately affixed around appropriate portions 9*a*, 9*b* of said child's guard 10.

Figure 5:
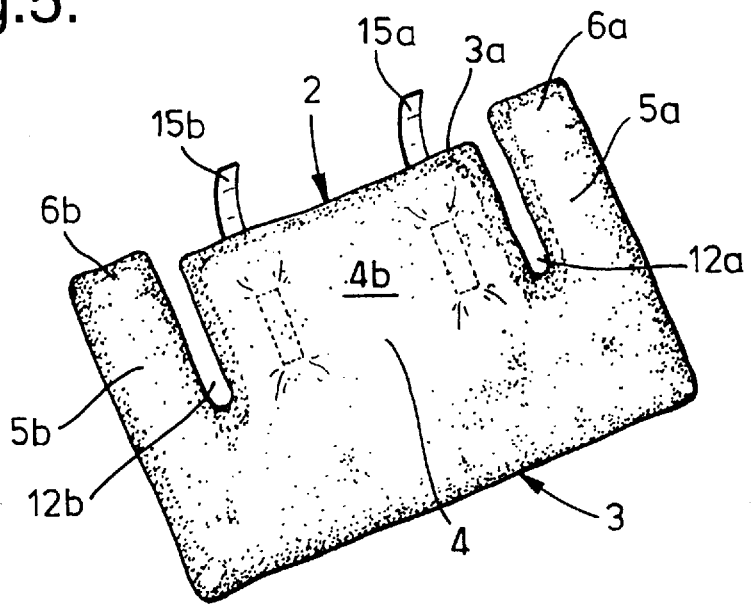
FIGS. 5 and 6 are views as seen from the one side and the other side, respectively, of that embodiment of a cushion which is illustrated in FIGS. 1–4, but here in unmounted condition.
Figure 6:
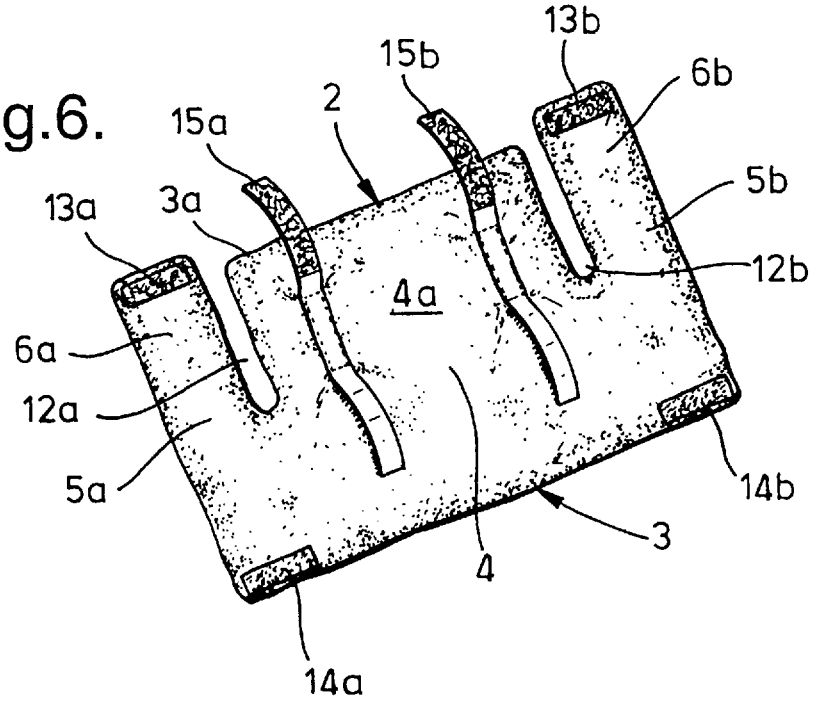

From FIGS. 5 and 6 it appears that the cushion 2 prior to mounting has a substantially rectangular shape, and that the main portion 4 which substantially serve to support the back area of the user also has a substantially rectangular shape, said side portions 5*a*, 5*b* being provided by means of appropriate notches 12*a*, 12*b*.

These notches 12*a*, 12*b* can be arranged substantially parallel in relation to each other and from the one side edge 3*a* of the main shape 3. However, it is to be understood that other shapes and proportions between the various portions of the cushion can be used within the scope of the present invention.

The side portions 5*a*, 5*b* are appropriately provided with affixing means 13*a*, 13*b* provided on the outer portions of the respective side portions, which affixing means can co-operate with corresponding affixing means 14*a*, 14*b* on opposite edge portions of the main portion 4 of the cushion, see also FIG. 4. Such affixing means can for example comprise velcro locks, straps, or similar, providing for an affixing objective for simple and reliable mounting of the cushion on the child's chair in question.

The cushion 2 also comprises further affixing means 15*a*, 15*b* provided on the mounting side 4*a* of the main portion 4. These further affixing means contribute, together with the previously discussed affixing means, to a mounting of the back cushion in an easy and safe manner, especially without the latter sliding around or being displaced in an uncomfortable manner for the user, see also FIG. 2.

Figure 7:
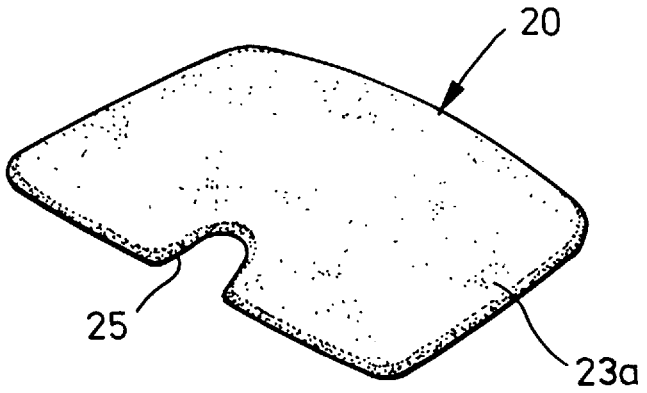
FIGS. 7 and 8 illustrate views as seen from the one and the other side, respectively, of a seat cushion which can be used together with a back cushion according to the invention.
Figure 8:
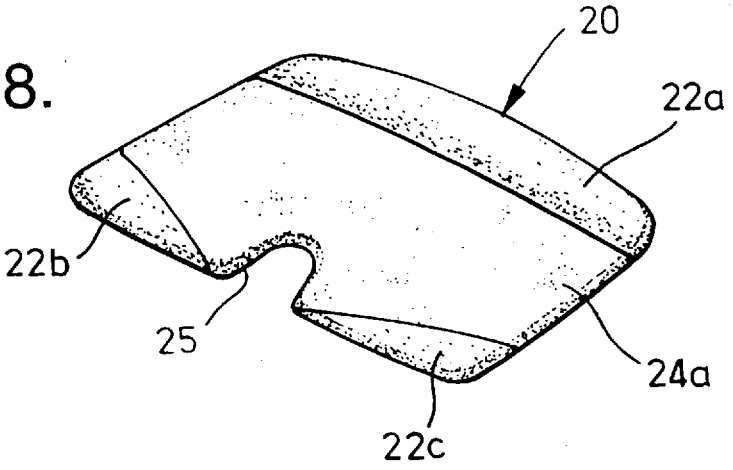
Figure 9:
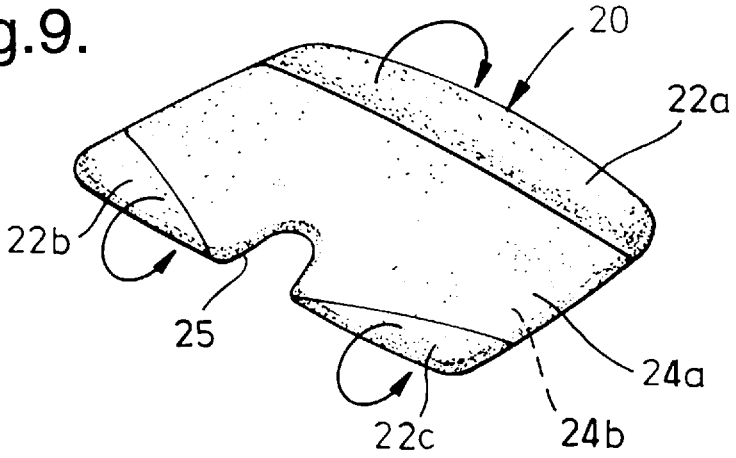
FIG. 9 is a view similar to FIG. 8, but with included symbol illustrating that edge portions of the cushion can be turned inside out.

In the embodiment illustrated according to FIGS. 1–6 the cushion 2 is contemplated to be formed as a separate unit, and it is appropriate that this separate unit is related to a separate seat cushion 20, for example of the embodiment as illustrated in FIGS. 7–9. There is here illustrated a separate seat cushion 20 which is adapted to the seat 21 of the previously discussed chair 1, whether this is provided with or without said child's guard.

The separate seat cushion 20 is provided with excess edge portions 22*a*, 22*b*, 22*c* which can be slipped around corresponding edge portions of the chair seat 21 for the attachment thereto, and if these edge portions 22*a*, 22*b*, 22*c* are arranged for being turned inside out, which is indicated by the arrows in FIG. 9, this will allow that an arbitrary side 24*a*, 24*b* of the seat cushion can constitute the use surface.

Appropriately, the seat cushion 20 can be provided with a front cut-out 25, which is specifically favourable if the cushion 20 is to be used on a chair seat 21 which is arranged to give support for a child's guard 10, see especially FIG. 3, said cut-out 25 allowing the mounting and demounting of said cushion 20 without removal of the child's guard 10.

It is also appropriate that the seat cushion 20 has a main surface extension corresponding to the surface extension of the seat 21, which renders the same good cushion function independent of the seat depth and the height adjustment of the seat 21.

It is to be understood that both types of cushions can be manufactured separately, but it is also contemplated a certain form of association between said cushions, for example by means of appropriate detachable connections.

Further, it is to be understood that the separate or connected cushions may favourably be manufactured from a material which can easily be cleaned, and said cushions should also in a rapid and effective way be demounted and remounted in relation to the chair, and said cushion or cushions should also have an appropriate user softness.

What is claimed is:

1. A cushion for a child's chair of the type having a seat, a back support and a detachable, arcuate child guard protruding forward of the back support, said cushion comprising:

a main center portion constructed to be mounted in an upright position in the chair above the seat and dimensioned and shaped to substantially cover the back support and extending at least as high the back support when mounted in the chair;

a transition region extending laterally on each side of said center portion and being of substantially lesser height than said center portion; and a side portion laterally outward of each transition region and extending substantially thereabove, free of said center portion to form a free end, said side portion being constructed to be secured to one of said back support and said child guard;

said side portions being constructed to pivot about an upright axis between a first position in which they are substantially coplanar with said center portion and a second position in which they are pivoted forward of said center portion, said side portions being secured to said back support in said first position to define a extended back supporting cushion, said side portions being brought to said second position when a child guard is in use and secured thereto to define an extended side support, whereby said cushion may be used to provide selectively an extended side support or an extended back support.

2. A cushion as claimed in claim 1 wherein the cushion before mounting has a substantially rectangular main shape, the main center portion also having a substantially rectangular form, and said transition regions and side portions are provided by means of downwardly extending notches.

3. A cushion as claimed in claim 2, wherein said notches are arranged substantially parallel in relation to each other and to side edges of the main center portion.

4. A cushion as claimed in claim 1, wherein said side portions are provided with appropriate first affixing means.

5. A cushion as claimed in claim 4 wherein the cushion comprises further affixing means arranged on the side of the main portion facing away from a child when the cushion is in use.

6. A cushion as claimed in claim 5, wherein said cushion comprises affixing means which, in the mounted cushion, prevent displacement of the cushion.

7. A cushion claimed in claim 5 wherein said cushion comprises affixing means which, in the mounted cushion, prevent displacement of the cushion.

8. A cushion as claimed in claim 4, wherein said first affixing means are complementary velcro areas.

9. A cushion as claimed in claim 1, wherein said cushion is for use in a child's chair comprising a back support composed of two parallel ribs running substantially horizontally at a related distance, the side portions of the cushion being adapted to be one of: affixed on the one back support rib of the chair as expanded back support portion in the area of said back support ribs; or affixed on said child guard as side support portion in an area of said child's guard, when the child guard is in use.

10. A cushion as claimed in claim 1, wherein said cushion is provided as a separate unit from any seat cushion adapted to the seat of the chair whether or not a child's guard is used.

11. A cushion as claimed in claim 10, further comprising a separate seat cushion having cuff-like edge portions which can be slipped around corresponding edge portions of the chair seat for attachment thereto.

12. A cushion in accordance with claim 11, wherein the seat cushion is provided with a cut-out which cut-out renders access for demounting even with a child's guard mounted on a chair.

13. A cushion as claimed in claim 11, wherein the seat cushion has a main surface area corresponding to the surface area of the seat, whereby the seat cushion renders a similar good cushion function independent of the depth and height adjustment of the seat.

14. A cushion as claimed in claim 11, wherein said seat cushion edge portions are constructed to be reversible for allowing an arbitrary side of the seat cushion as a use surface.

15. A cushion as claimed in claim 10, wherein the said seat cushion comprises edge portions which can be reversed for allowing an arbitrary side of the seat cushion as a use surface.

16. A cushion in accordance with claim 1 wherein at least said free ends of said side portions are constructed so as to be bendable back towards the side portions, said free ends being bent over and secured to the back support in said first position and being bent over and secured around the child guard in said second position.

17. A cushion as claimed in claim 16, wherein the cushion before mounting has a substantially rectangular main shape, the main center portion aslo having a substantially rectangular form, and said transition regions and side portions are provided by means of downwardlyl extending notches.

* * * * *